US007621503B2

(12) United States Patent
Warren et al.

(10) Patent No.: US 7,621,503 B2
(45) Date of Patent: Nov. 24, 2009

(54) MULTIPURPOSE HAMMER

(75) Inventors: Jon Warren, Redding, CA (US); Allan Jeffers, Redding, CA (US); Curtis Lupo, Redding, CA (US)

(73) Assignee: Nightshift Group, LLC, Reno, NV (US)

( * ) Notice: Subject to any disclaimer, the term of this patent is extended or adjusted under 35 U.S.C. 154(b) by 0 days.

(21) Appl. No.: 11/174,773

(22) Filed: Jul. 5, 2005

(65) Prior Publication Data

US 2007/0006686 A1 Jan. 11, 2007

(51) Int. Cl.
*B66F 15/00* (2006.01)

(52) U.S. Cl. ..... 254/26 R; 254/21; 254/26 E

(58) Field of Classification Search ..... 254/26 R, 254/26 E, 27, 28, 25, 21; 7/164
See application file for complete search history.

(56) References Cited

U.S. PATENT DOCUMENTS

| | | | | |
|---|---|---|---|---|
| 5,697 | A | 8/1848 | Powers | |
| 64,662 | A | 5/1867 | Gold | |
| 103,678 | A | 5/1870 | Stockwell | |
| 147,113 | A | 2/1874 | Ellsworth | |
| 333,539 | A * | 1/1886 | Palmer | 254/25 |
| 356,925 | A | 2/1887 | Chamberlin | |
| 493,989 | A | 3/1893 | Duryea | |
| 640,452 | A * | 1/1900 | Date | 254/26 R |
| D34,663 | S | 6/1901 | Yonge | |
| 835,961 | A | 11/1906 | Lee | |
| 875,724 | A | 1/1908 | Mullinix | |
| 888,987 | A * | 5/1908 | Kiehle | 24/695 |
| D45,761 | S | 5/1914 | Miller | |
| 1,409,723 | A * | 3/1922 | Jacob | 33/1 A |
| 1,535,685 | A | 4/1925 | Randell | |
| 1,808,705 | A * | 6/1931 | Owen, Jr. | 33/27.03 |
| 2,420,120 | A | 5/1947 | Bruchsaler | |
| 2,491,129 | A | 12/1949 | Nieuwsma | |
| 2,501,757 | A | 3/1950 | Cagle | |

(Continued)

OTHER PUBLICATIONS

"BioCurve Ergonomic Hammers," Barco catalogue, p. 12.

(Continued)

*Primary Examiner*—Lee D Wilson
(74) *Attorney, Agent, or Firm*—Gordon & Jacobson, PC

(57) ABSTRACT

A multipurpose hand tool includes a head, a shank and a handle. The head includes a nail-pulling section, a bridge section and a nail-striking section. The shank extends from the bridge section to the handle. Preferably, the nail-pulling section defines a nail-head-receiving cavity accessible from the rear with nail-body-receiving upper and lower slots leading thereto. In the preferred embodiment, the nail pulling section comprises a segmented top wall, a segmented bottom wall and side walls that define the cavity. The nail pulling section and nail striking section preferably include base surfaces that are substantially flat and aligned in a common plane. The sides of the shank extend downward from the bridge section at a direction substantially orthogonal to this common plane to realize a T-square that can be used for orthogonal line marking. The shank preferably includes other features that are used for measurement and marking. The handle preferably includes an elongate section and a larger end section that extends at an angle relative to the elongate section. One side of the end section has a rib that ergonomically fits into the palm of the user's hand.

31 Claims, 9 Drawing Sheets

U.S. PATENT DOCUMENTS

| | | | | |
|---|---|---|---|---|
| 2,753,151 | A * | 7/1956 | Svehaug | 254/26 R |
| 3,119,424 | A | 1/1964 | Henry | |
| 4,732,058 | A | 3/1988 | Chung | |
| 5,235,755 | A | 8/1993 | Fowler | |
| D375,033 | S | 10/1996 | Edwards | |
| 5,826,466 | A * | 10/1998 | Weissbach | 7/164 |
| 6,058,539 | A | 5/2000 | Mitford-Taylor | |
| 6,266,834 | B1 | 7/2001 | Walsh et al. | |
| D455,626 | S * | 4/2002 | Chen | D8/78 |
| 6,793,200 | B2 * | 9/2004 | Bystrom | 254/26 R |
| 2002/0088130 | A1 | 7/2002 | Szumer | |

OTHER PUBLICATIONS

"18 oz. Douglas Finish Hammer with 14-inch Handle," Duluth Trading website at http://www.duluthtrading.com/items/95646.asp.
"Death Stick 21 oz. Ax Handle Hammer," available from Toolmart website at http://www.toolmarts.com/don21a.html.

* cited by examiner

FIG. 12
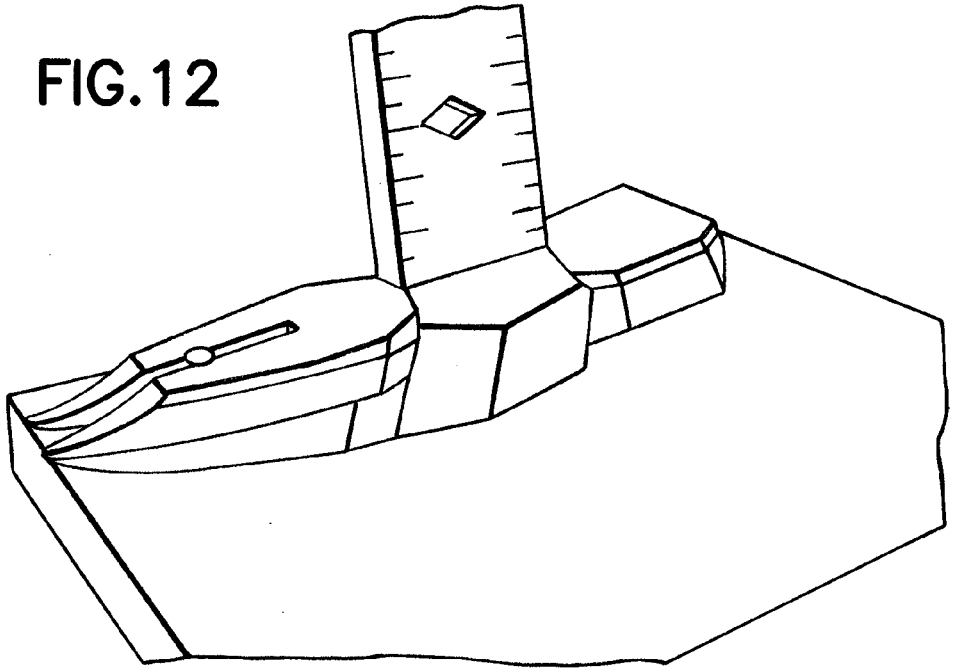
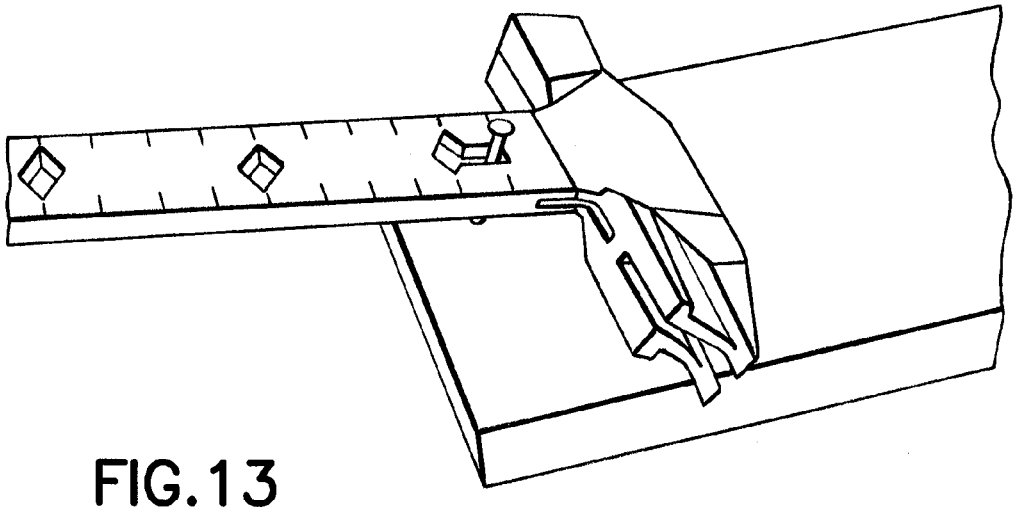
FIG. 13

MULTIPURPOSE HAMMER

BACKGROUND OF THE INVENTION

1. Field of the Invention

This invention relates broadly to hand tools used for construction. More particularly, this invention relates to multipurpose hand tools such as a hammer for nailing, nail pulling and measuring and marking objects such as floor joists, studs, ceiling joists, rafters, framing materials, subflooring, sheathing boards, dry wall, etc.

2. State of the Art

Multipurpose hammers that can be used to strike and pull nails as well as perform common measurements are known in the art. For example, U.S. Pat. No. 4,732,058 demarks a hammer with a neck member that includes an 8 inch measuring scale along one edge with a similar scale in centimeters along an opposite edge. However, it is difficult to accurately measuring distance with this hammer because the user must locate and maintain the top of the hammer at the desired origin of the measurement. This is cumbersome and prone to error.

Moreover, such multipurpose hammers do not aid the user in performing other common measurement and marking operations, including orthogonal line marking (which is typically performed in conjunction with a T-square), parallel line and/or angled line marking operations relative to the edge of a board (which are typically performed in conjunction with a tape measure and straight edge or snap line), etc. Thus, in order to carry out these common measurement and marking operations, one must carry and manipulate a large number of tools, which is burdensome in both energy and time for the user.

SUMMARY OF THE INVENTION

It is therefore an object of the invention to provide a multipurpose hammer that effectively and accurately measures distance.

It is another object of the invention to provide a multipurpose hammer that aids users in performing common measurement and marking operations, including orthogonal line marking, parallel line marking, angled line marking, etc.

It is a further object of the invention to provide a multipurpose hammer with a handle that is ergonomically designed to fit within the palm of the user's hand.

It is also an object of the invention to provide a multipurpose hammer with improved leverage in pulling nails.

In accord with these objects, which will be discussed in detail below, a multipurpose hammer includes a head, a shank and a handle. The head includes a nail-pulling section, a bridge section and a nail-striking section. The shank extends from the bridge section to the handle. Preferably, the nail-pulling section defines a cavity accessible from the rear with an upper and lower slot leading thereto, wherein the cavity is adapted to receive a nail head therein with the upper and lower slots each adapted to receive an elongate nail body therein. In the preferred embodiment, the nail pulling section comprises a segmented top wall, a segmented bottom wall and side walls that define the cavity, wherein the upper slot is disposed between segments of the top wall and the lower slot is disposed between segments of the bottom wall. The base surface of the segmented bottom wall is substantially flat, and the upper surface of the segmented top wall is angled relative thereto. These features provide for single clutch nail pulling as well as double clutch nail pulling improved leverage.

According to one embodiment of the invention, the base surfaces of the nail pulling section and nail striking section are substantially flat and aligned in a common plane. The sides of the shank extend downward from the bridge section at a direction substantially orthogonal to this common plane to realize a T-square that can be used for orthogonal line marking.

According to another embodiment of the invention, the shank preferably includes at least one of the following: a set of through-holes that are disposed at predetermined offsets along the shank that can be used for parallel line marking; a set of visible indicia that define a ruler used for measurement and marking; a set of visual indicia that each extend along a face of the shank at a predetermined offset angle for angled line marking; and a slot through the shank for nail pulling.

It will be appreciated that such features enable the user to perform a variety of common measurement and marking operations, including accurate distance measurement, orthogonal line marking, parallel line marking, angled line marking, etc.

According to yet another embodiment of the present invention, the handle preferably includes an elongate section and a larger end section that extends at an angle relative to the elongate section. One side of the end section has a rib that ergonomically fits into the palm of the user's hand.

Additional objects and advantages of the invention will become apparent to those skilled in the art upon reference to the detailed description taken in conjunction with the provided figures.

BRIEF DESCRIPTION OF THE DRAWINGS

FIG. 12 is a picture illustrating a double clutch nail pulling operation of the multipurpose hand tool of FIG. 1, which affords the user with improved leverage over the single clutch nail pulling operation.

FIG. 13 is a picture illustrating a nail pulling operation using a through-slot in the shank member of the multipurpose hand tool of FIG. 1.

DETAILED DESCRIPTION

Figure 1:
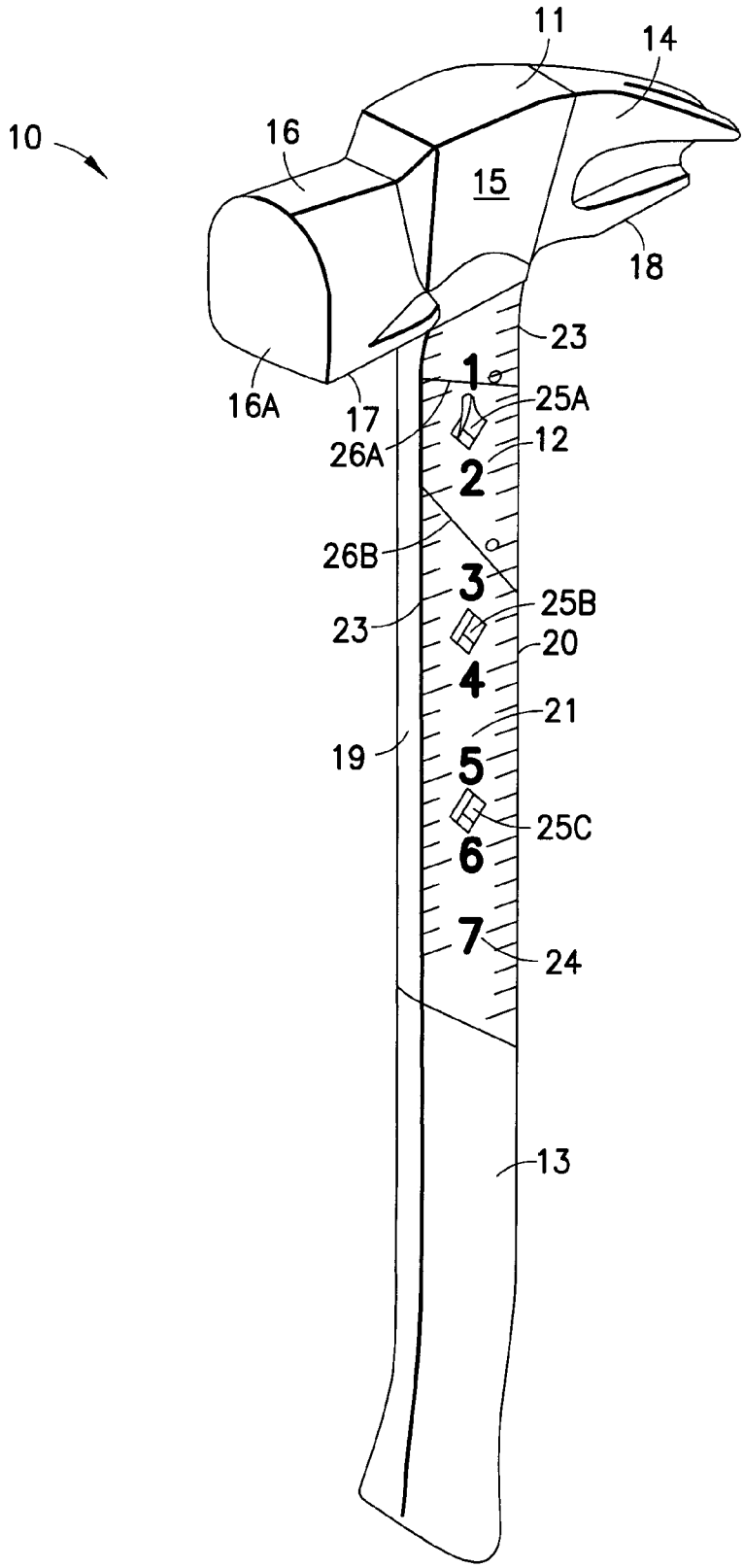
FIG. 1 is a perspective view of a multipurpose hand tool in accordance with the present invention.

Turning now to FIG. 1, a multipurpose hammer 10 according to the present invention includes a head member 11, a shank member 12, and a handle member 13. The head member 11 includes a rear section 14, a bridge section 15, and a nose section 16. The rear section 14 is used for nail pulling, while the face 16A of the nose 16 is used for striking nails into objects. The face 16A may have a cross-hatched groove pattern (not shown) formed thereon.

Figure 8:
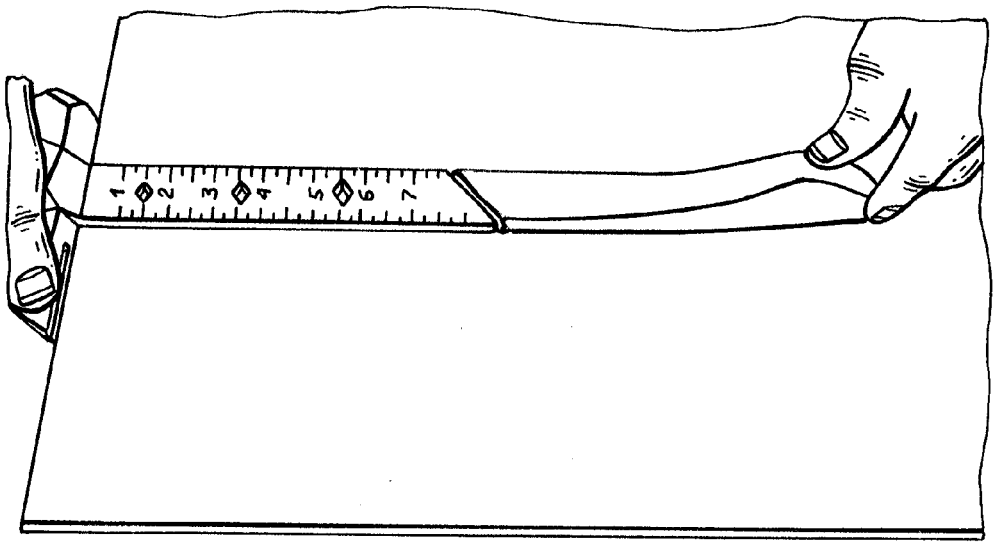
FIG. 8 is a picture illustrating the operation of the multipurpose hand tool of FIG. 1 as a T-square.

As best shown in FIGS. 1, 2, 3A, and 6, the base 17 of the nose section 16 and the base 18 of the rear section 14 are substantially flat and aligned in a common plane. The shank member 12 projects down from the bridge section 15 of the head member 11. The sides 19 and 20 of the shank member 12 extend downward from the bridge section 15 at a direction orthogonal to the common plane of the bases 17,18. In this manner, the bases 17, 18 of the head member 11 together with the sides 19, 20 of the shank member 12 define a T-Square, which can be used to identify a line orthogonal to the edge of board and mark a line (or other indicia such as a point or cross) along this line. More particularly, the user places the bases 17, 18 of the head member 11 against the edge of a board with the shank member 12 laying on the board as shown in FIG. 8. The sides 19, 20 of the shank member 12 identify a line orthogonal to the edge of the board. The user then marks a line (or makes a mark) along one side (or both sides) of the shank member 11. This line (or mark) lies along a line orthogonal to the edge of the board.

Figure 2:
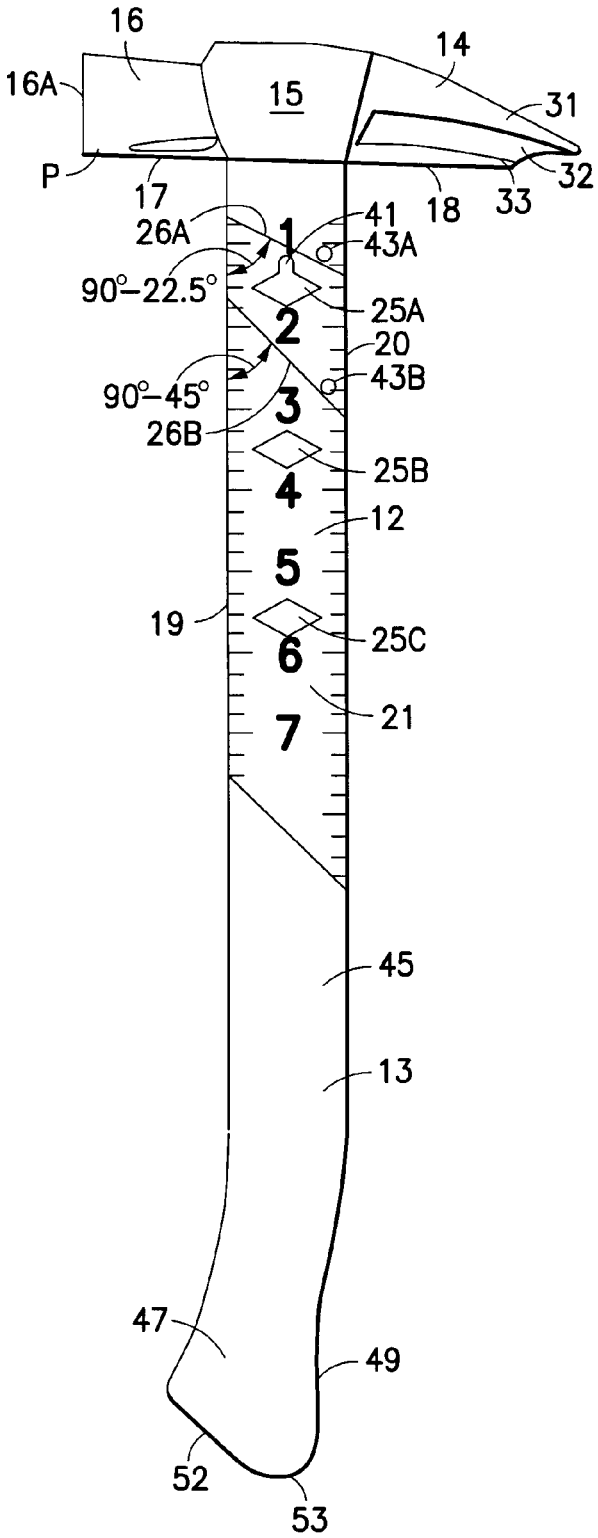
FIG. 2 is a side view of the multipurpose hand tool of FIG. 1.

As shown in FIGS. 1 and 2, the face 21 of the shank member 12 includes a set of grooves 23 and/or other visible indicia such as the numbers 1, 2, . . . 7 (labeled 24) that are spaced apart at regular intervals along the edges of the respective face of the shank member 12 to thereby define a ruler that can be used for measurement and marking. In the preferred embodiment, the numbers 1, 2, . . . 7 are spaced apart at 1 inch intervals, a set of longer grooves (or other visible indicia) are disposed along each face at ½ inch intervals starting from the base of the head/start of the shank, and a set of shorter grooves (or other visible indicia) disposed along each face at ¼ inch intervals between the longer grooves. Preferably, the grooves 23 and numbers 24 that define the shank ruler are also added to the opposite face 22 of the shank member 12 such that the tool is symmetrical for right-hand and left-hand use. Alternatively, the grooves 23 and numbers 24 that define the shank ruler may be included on only one of the faces 21, 22 of the shank member 12; or one face may include grooves and numbers indicating inches, while the other face may have grooves and numbers indicating centimeters.

Figure 9:
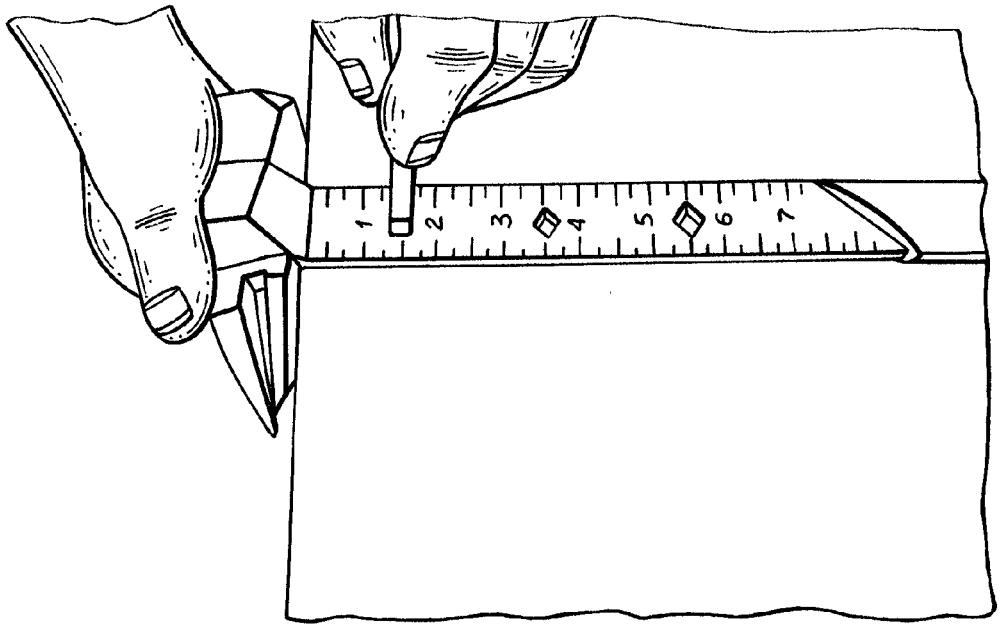
FIG. 9 is a picture illustrating the operation of the multipurpose hand tool of FIG. 1 in marking a line parallel to the edge of a board.

The shank member 12 also includes a set of through-holes (for example, three shown as 25A, 25B, 25C) that are positioned along the shank member 12 at predetermined distances relative to the bases 17, 18 of the head member 11. Such predetermined distances correspond to the common mark lengths, preferably including 1.5 inches, 3.5 inches, and 5.5 inches. Preferably, the holes 25A, 25B, 25C have a diamond shape (FIGS. 1 and 2). The holes 25A, 25B, 25C can be used for marking lines on boards as follows. First, the user places the bases 17, 18 of the head member 11 against the edge of a board with the shank member 12 lying on the board. A pencil (or other marker) is inserted into the desired hole (25A, 25B, 25C) such that its tip engages the board surface and is supported within the desired hole. In the preferred embodiment shown, the tip of the pencil/marker is inserted into the desired diamond-shaped hole such that it engages the board surface and is supported by one of the side corners of the diamond-shaped hole. The user then drags the tool 10 along the edge of the board, thereby causing the pencil/marker to create a marked line parallel to the edge of the board at an offset corresponding to the distance between the selected hole and the bases 17, 18 of the head member 11 as shown in FIG. 9.

Figure 10:
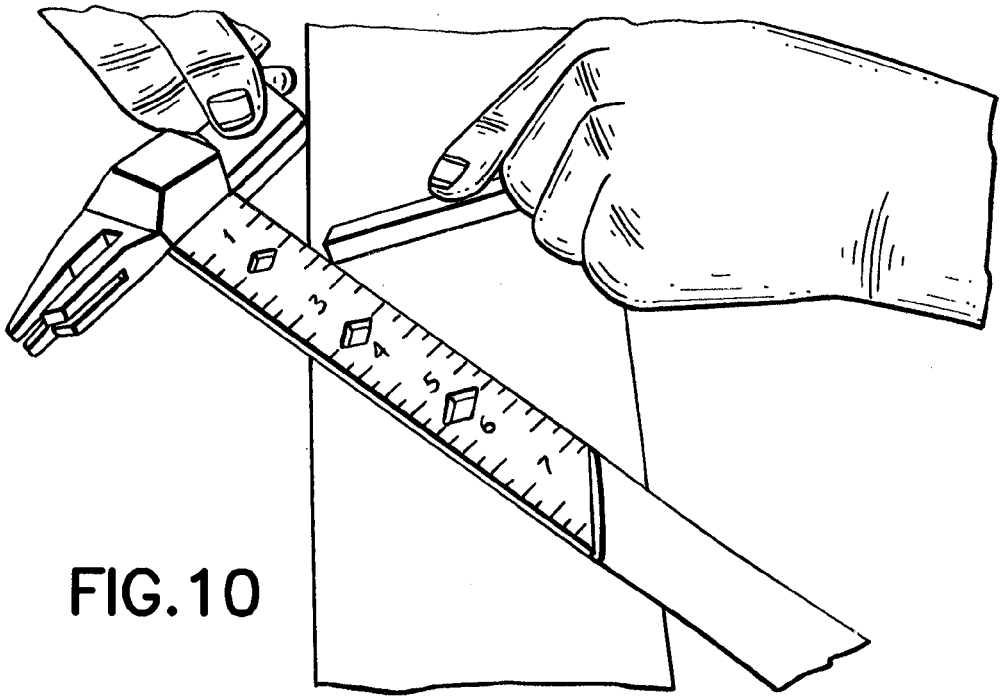
FIG. 10 is a picture illustrating the operation of the multipurpose hand tool of FIG. 1 in marking a line oriented at an angle relative to the edge of a board.

The shank member 12 also includes a set of one or more angled grooves (for example, two shown as 26A, 26B) that extend along the face 21 of the shank member 12. Preferably, such angled grooves are also added to the opposite face 22 of the shank member 12 such that the tool is symmetrical for right-hand and left-hand use. Alternatively, the angled grooves may be included on only one of the faces 21, 22 of the shank member 12. The angled grooves (26A, 26B) are oriented at predetermined angles relative to the sides 19, 20 of the shank member 12. Such predetermined angles correspond to the common mark angles. In the exemplary embodiment as best shown in FIG. 2, the groove 26A is oriented at an angle of (90 degrees−22.5 degrees), or 67.5 degrees, relative to the side 19 of the shank member 12, while the groove 26B is oriented at an angle of (90 degrees−45 degrees), or 45 degrees, relative to the side 19 of the shank member 12. Moreover, the angle grooves 26A, 26B project to a common point P that lies at intersection of the nose face 16A and the nose base 17. The groove 26A is used for 22.5 degree angle marks while the groove 26B is used for 45 degree angle marks as follows. First, the user lays the shank member 12 on a board and orients the tool 10 such that the point P and the desired angled groove (26A or 26B) are aligned with the edge of the board. In this configuration, each side (19, 20) of the shank member 12 defines a line that is offset at an angle relative to the edge of the board. The offset angle of this line corresponds to the offset angle (22.5 degrees or 45 degrees) of the selected angle groove (26A or 26B). The user then marks a line (or makes a mark) along a side of the shank member 12 such that the scribed line/mark it is oriented at the desired angle as shown in FIG. 10.

Figure 7A:
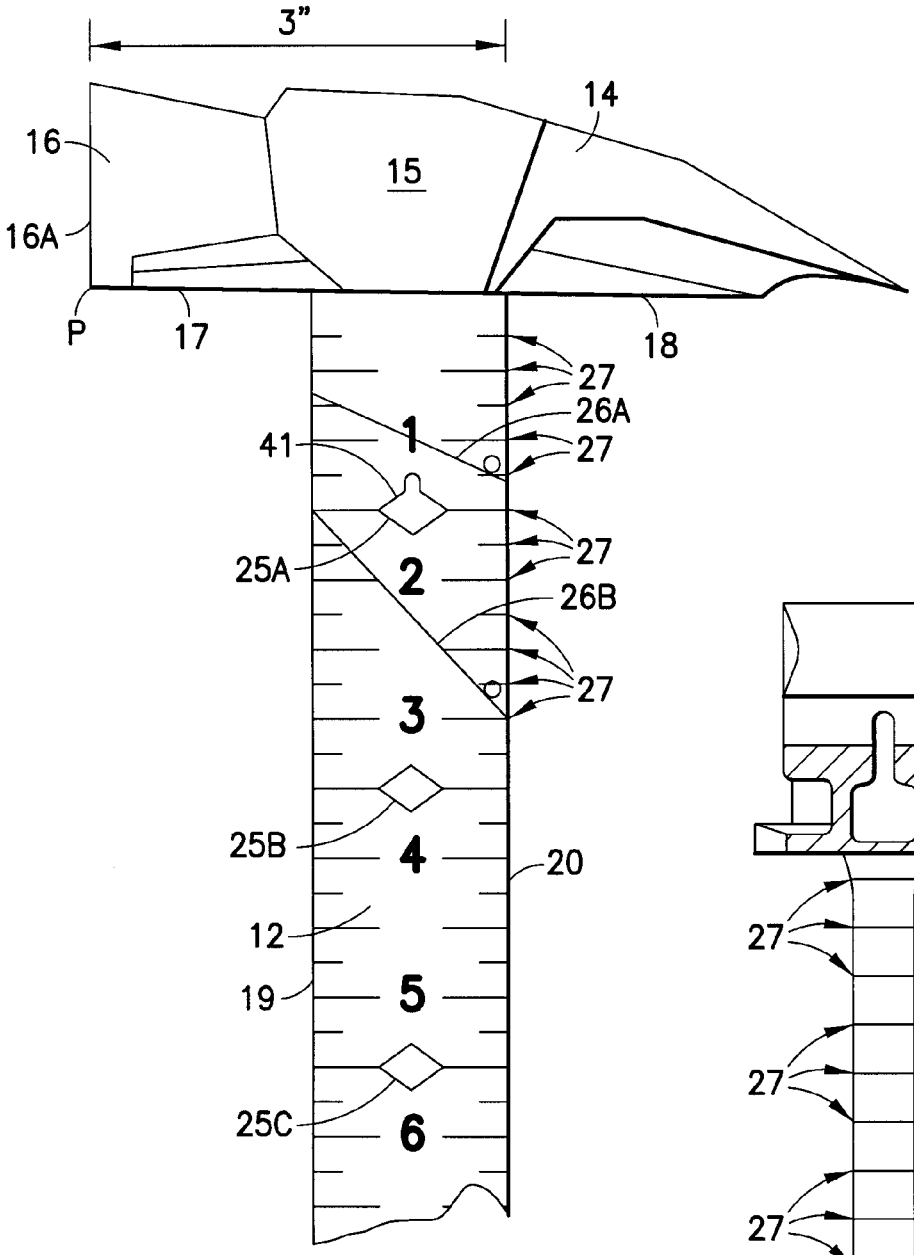
FIG. 7A is a side view of an alternate embodiment of a multipurpose hand tool in accordance with the present invention.
Figure 7B:
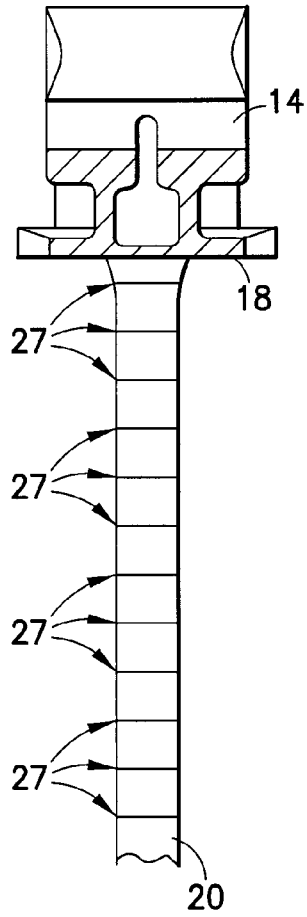
FIGS. 7B and 7C are rear views of the multipurpose hand tool of FIG. 7A, showing a side of the shank member.

In an alternate embodiment shown in FIGS. 7A and 7B, the side 20 of the shank member 12 includes a set of grooves 27 and/or other visible indicia that are spaced apart at regular intervals along the length of the side 20 of the shank member 12. The grooves 27 define lines (not shown) that project from the respective grooves to the common intersection point P as shown in FIG. 7A. These lines are oriented at predetermined angles relative to the sides 19, 20 of the shank member 12. Such predetermined angles correspond to the different mark angles. In the preferred embodiment shown in FIGS. 7A and 7B, a set of twelve grooves 27 are spaced apart every ¼ inch from the base of the head/start of the shank. The twelve grooves are offset laterally from the intersection point P by 3 inches. In this configuration, the line that projects from the sixth groove to the point P (which is marked by the groove 26A) corresponds to an angle of 22.5 degrees, while the line that projects from the twelfth groove (i.e., at 3 inches) to the point P (which is marked by the groove 26B) corresponds to an angle of 45 degrees. The lines that project from the other grooves to the point P correspond to different mark angles. The grooves or other visible indicia 27 are used for angle marking as follows. First, the user lays the shank member 12 on a board and orients the tool 10 such that the point P and the line projecting from the desired groove to the point P are aligned with the edge of the board. In this configuration, each side (19, 20) of the shank member 12 defines a line that is offset at an angle relative to the edge of the board. The offset angle of this line corresponds to the angle of the line projecting from the desired groove to the point P. The user then marks a line (or other visible indicia) along a side of the shank member 12 such that the scribed line/mark is oriented at the desired angle in a manner similar to that shown in FIG. 10.

Figure 7C:
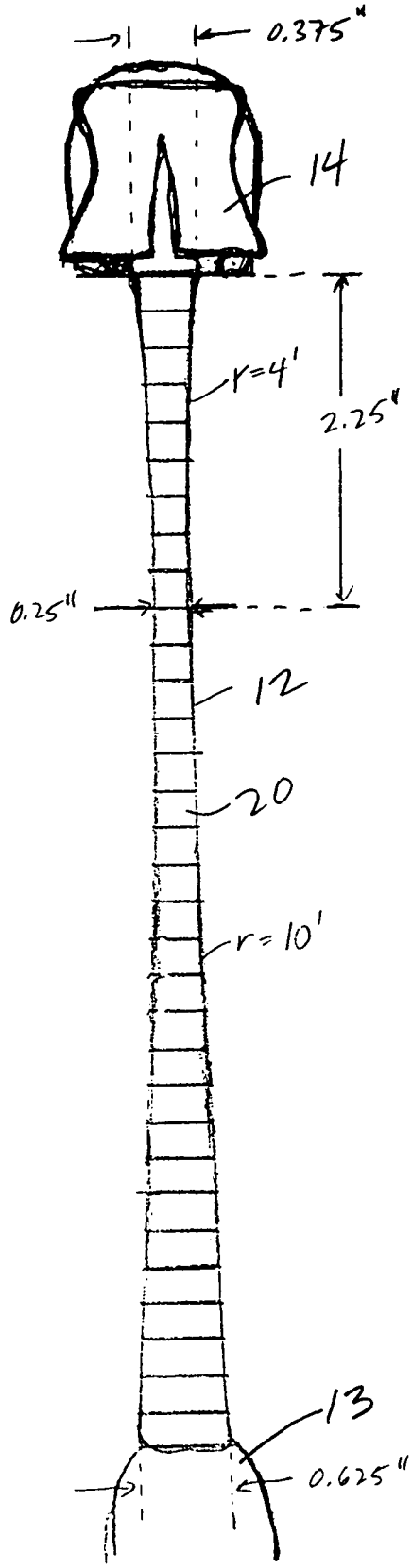

As shown in FIG. 7C, the sides 19 and 20 of the shank member 12 are concave in an elliptical fashion. This arched edge in tandem with the concave faces 21, 22 (FIG. 3B) create an extremely accurate marking shank when used with framing material. Preferably, the top 2.25 inches of the sides 19 and 20 have a radius of curvature of approximately 4 feet, and the remainder of the sides 19 and 20 have a radius of curvature of 10 feet as shown. Preferably, the width of the sides 19 and 20 at the junction of the shank member 12 and the base 18 of the head member 11 is approximately 0.375 inches, the width of the sides 19 and 20 at the junction of the shank member 11 and the handle member 13 is approximately 0.625 inches, and the width of the sides 19 and 20 at an offset of 2.25 inches from the junction of the shank member 12 and the base 18 of the head member 11 is approximately 0.25 inches as shown.

Figure 4:
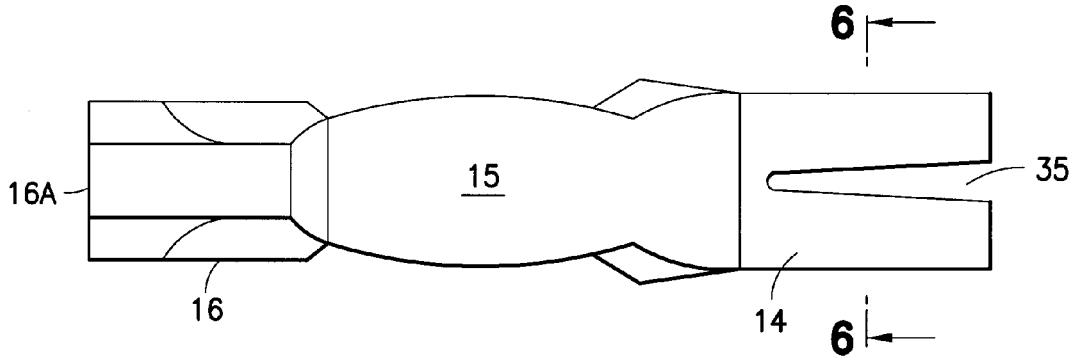
FIG. 4 is a top view of the multipurpose hand tool of FIG. 1.
Figure 5:
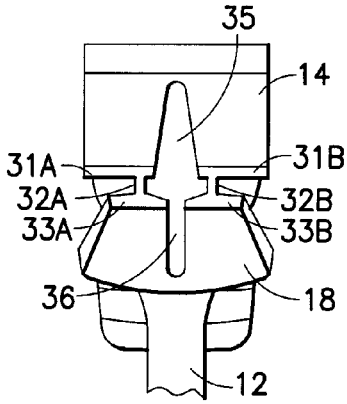
FIG. 5 is a rear perspective view of the head member of the multipurpose hand tool of FIG. 1.
Figure 6:
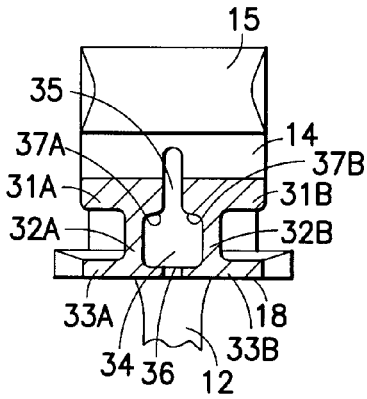
FIG. 6 is a rear cross-sectional view of the head member of the multipurpose hand tool of FIG. 1, showing the nail pulling section of the head member.

As best shown in FIGS. 4, 5 and 6, the rear section 14 of the head member 11 includes two top wall segments 31A, 31B, two side walls 32A, 32B and two bottom wall segments 33A, 33B that define two tapered claw members extending rearward with a central opening 34 therebetween. The central opening 34 is accessible from the rear of the head member 11. The upper surface of the top wall segments 31A, 31B are angled (FIG. 2), preferably, at an angle relative to the base 18 between 22 degrees and 28 degrees, and most preferably at an angle relative to the base 18 of 24 degrees. A first slot 35 defined by the top wall segments 31A, 31B leads to the central opening 34 from above. The exterior surface or base 18 of the bottom wall 33 is substantially flat and perpendicular to the shank member 12 for marking as described above. A second slot 36 defined by the bottom wall segments 33A, 33B leads to the central opening 34 from below. The second slot 36 is aligned with the first slot 25 such that the two slots 35, 36 can receive the elongate body of the nail. The top wall segments 31A, 31B include respective ledges 37A, 37B that are disposed along the central opening 34 adjacent the first slot 35.

Figure 11:
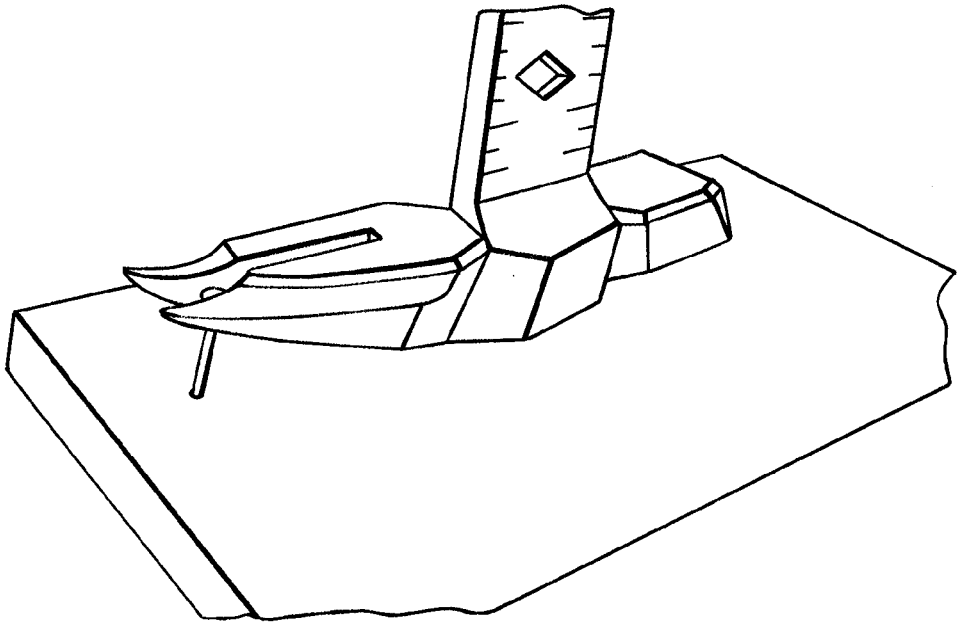
FIG. 11 is a picture illustrating a single clutch nail pulling operation of the multipurpose hand tool of FIG. 1.

For single clutch nail pulling, the head of the nail is disposed within the central opening 34 with the elongate body of the nail passing through the first slot 35. The ledges 37A, 37B interface to the nail head for removal of the nail as shown in FIG. 11.

For double clutch pulling, which is typically performed after single clutch pulling and provides improved leverage over single clutch pulling, the head of the nail is disposed adjacent the base 18 of the bottom wall 33 with the elongate body of the nail passing through both the first and second slots 35, 36. The base 18 of the bottom wall 33 interfaces to the nail head for removal of the nail as best shown in FIG. 12. The base 18 can also be used for nail pulling in the event that there is sufficient clearance to between the nail head and the object, for example, where the nail has been partially hammered out of a board or where the nail is bent during hammering.

As best shown in FIG. 2, the top wall 31 preferably extends rearward beyond the bottom wall 33 with the ends of the sidewalls 32 therebetween curved to accommodate this structure. This design allows the user to efficiently and effectively insert nail heads into the central opening 34 for single clutch pulling as described above.

Figure 3A:
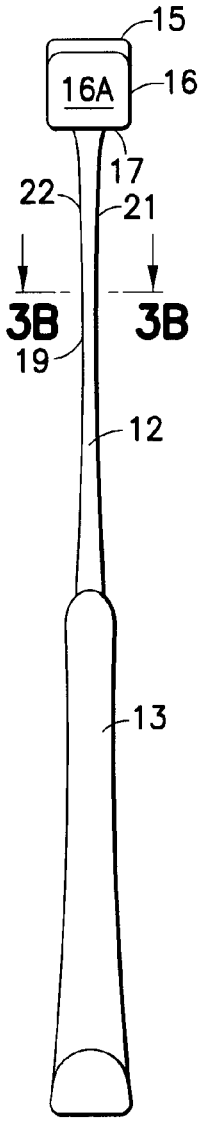
FIG. 3A is a front view of the multipurpose hand tool of FIG. 1.
Figure 3B:
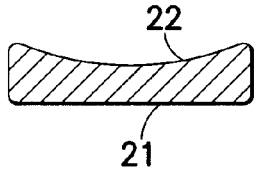
FIG. 3B is a cross-sectional view of the shank of the multipurpose hand tool of FIG. 1.

As best shown in FIG. 3B, the shank member 12 is crowned (or concave) on both of its faces 21, 22 in order to provide improved accuracy and a solid fit (e.g., reduced rocking motion) when using the tool on crowned and splintered wood.

As best shown in FIG. 2, the shank member 12 also preferably includes a slot 41 through the shank member 12 that receives the elongate body of a nail for pulling the nail as shown in FIG. 13. The slot 41 is preferably disposed 2⅝ inches from the top of the head member 11 of the tool. This location provides optimal fulcrum point for pulling 16D nails (the most commonly used nails for carpentry applications).

Preferably, the width of faces 21, 22 of the shank member is on the order of 1⅜ inches or 1 7/16 inches. These widths correspond to the width of a stud (2×4 or 2×6) plus the pencil width. Whenever a 90 degree intersection is needed (on wall plates for example), the layout or position for both sides can be easily marked without movement of the tool 10. This feature improves stud placement accuracy.

As shown in FIG. 2, the shank member 12 may also include additional through-holes (for example two shown as 43A, 43B). The through-holes 43A, 43B are preferably disposed adjacent corresponding angled grooves 26A, 26B as shown and have an annular shape with a smaller diameter (e.g., on the order of ⅛$^{th}$ inch). A nail (e.g., an 8D nail for a ⅛$^{th}$ inch hole) is dropped into the hole. The nail acts as a stop against the object for angle marking as described herein and best shown in FIG. 10.

Figure 14:
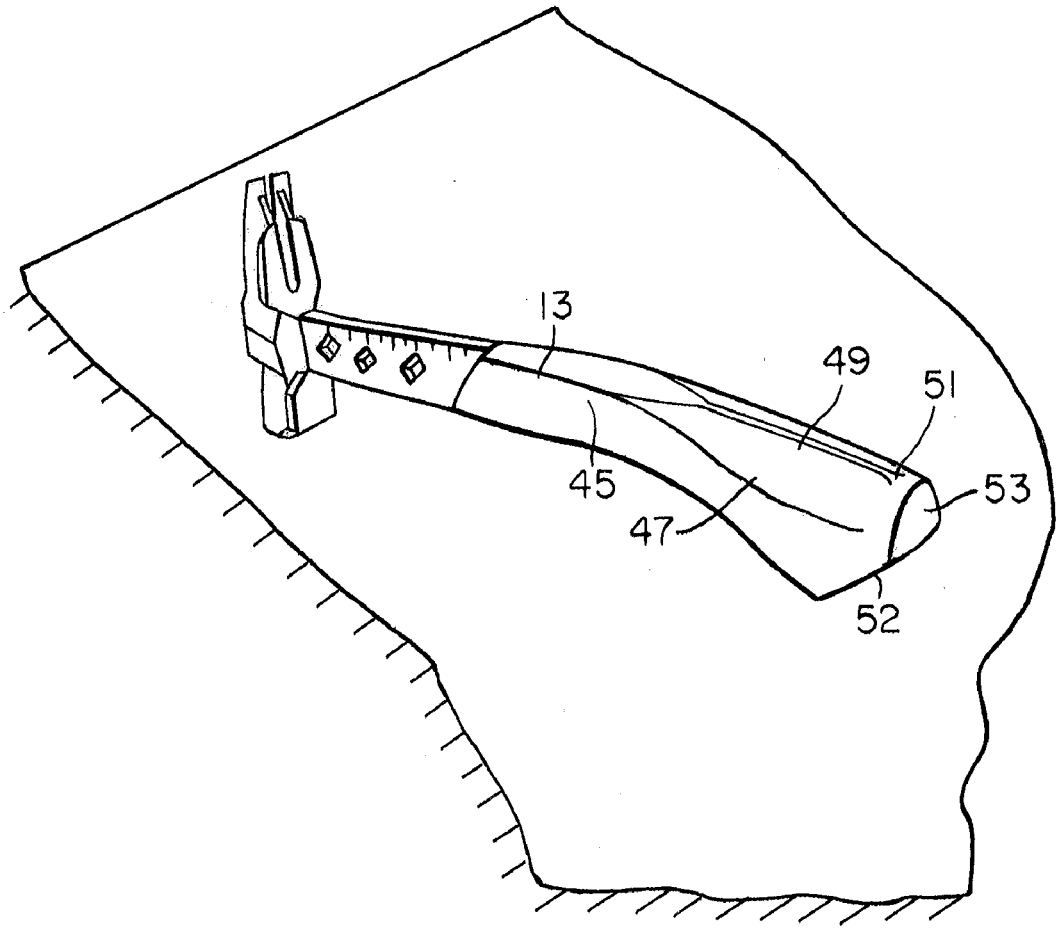
FIG. 14 is a picture illustrating an exemplary ergonomic palm relief structure of the handle member of the multipurpose hand tool of FIG. 1.

The head member 11 and shank member 12 are preferably realized from steel, with the handle member 13 preferably realized from a wooden or composite material that is affixed to the shank member 12. As best shown in FIG. 2, the handle member 13 is preferably ergonomically designed with an elongate section 45 and a larger angled end section 47. The rear side 49 of the end section 47 has a rib 51 as best shown in FIG. 14. This rib 51 is adapted to fit in the hip of the palm of the hand in use. The angle between the elongate section 45 and the larger end section 47 is preferably between 5 and 20 degrees, which allows the hand to grip the handle in its most natural positions (with a straight wrist). The end section 47 also has an angled surface 52 extending from an end surface 53 that is oriented parallel to the bases 17, 18 of the head member 11 preferably at a distance of 16 inches. The end surface 53 is used for line marking in a manner similar to that described above with respect to FIG. 8. The angled surface 52 provide for ease of use when sliding the tool 10 into a bag. It also affords an improved ergonomic fit to the hand when holding the tool low.

There have been described and illustrated herein several embodiments of a multipurpose hand tool and corresponding methods of use. While particular embodiments of the invention have been described, it is not intended that the invention be limited thereto, as it is intended that the invention be as broad in scope as the art will allow and that the specification be read likewise. Thus, while particular visual indicia (such as grooves) have been disclosed, it will be appreciated that other visual indicia such as printed lines, engraved lines, raised ridges or other suitable visual indicia can be used as well. In addition, while a number of particular features have been disclosed, it will be understood that such features can be used alone, in combination with a subset of the features described herein, or in combination with other hand tool devices. Moreover, while particular configurations have been disclosed, it will be appreciated that other configurations could be used as well. It will therefore be appreciated by those skilled in the art that yet other modifications could be made to the provided invention without deviating from its spirit and scope as claimed.

What is claimed is:

1. A multipurpose hand tool comprising:

a head comprising a nail-pulling section, a bridge section and a nail-striking section;

a handle; and a shank extending from the bridge section of the head to the handle, the shank having a generally rectangular cross-section with opposed major faces and minor sidewalls extending therebetween;

wherein the nail-pulling section defines two tapered claw members extending rearward with a cavity therebetween, the cavity accessible from the rear with an upper and lower slot leading thereto, the cavity for receiving a nail head therein with the upper and lower slots for receiving an elongate nail body therein;

wherein the nail pulling section and nail striking section of the head include base surfaces that are substantially flat and aligned in a common plane; and wherein the shank extends generally downward from the bridge section of the head at a direction substantially orthogonal to the common plane of said base surfaces.

2. A multipurpose hand tool according to claim 1, wherein:

the nail pulling section comprises a segmented top wall, a segmented bottom wall, and side walls that define said tapered claw members and said cavity, wherein the upper slot is realized in said top wall and the lower slot is realized in said bottom wall.

3. A multipurpose hand tool according to claim 2, wherein:

the segmented bottom wall has a base surface that is substantially flat and the segment top wall has an upper surface that is oriented relative to the base surface at an angle between 22 degrees and 28 degrees.

4. A multipurpose hand tool according to claim 1, wherein:

said top wall defines a ledge adjacent said upper slot, wherein the ledge is adapted to interface to a nail head disposed within the cavity for nail pulling.

5. A multipurpose hand tool according to claim 1, wherein:

the sidewalls of the shank extend downward from the bridge section of the head at a direction substantially orthogonal to the common plane of said base surfaces.

6. A multipurpose hand tool according to claim 5, wherein:

the shank includes opposing faces that are crowned (or concave).

7. A multipurpose hand tool according to claim 5, wherein:

the shank has a width selected from 1⅜ inches and 1 7/16 inches.

8. A multipurpose hand tool according to claim 1, wherein:

the shank includes a set of holes though the opposed faces of the shank that are disposed at predetermined offsets along the shank relative to said base surfaces.

9. A multipurpose hand tool according to claim 8, wherein:

said predetermined offsets correspond to common mark lengths including 1.5 inches, 3.5 inches, and 5.5 inches.

10. A multipurpose hand tool according to claim 1, wherein:

the shank includes a set of visible indicia that are spaced apart at regular intervals along the shank to thereby define a ruler that can be used for measurement and marking.

11. A multipurpose hand tool according to claim 10, wherein:

said set of visual indicia comprises grooves disposed along edges of at least one face of the shank as well as numbers disposed along the at least one face of the shank.

12. A multipurpose hand tool according to claim 1, wherein:

the shank includes a set of visual indicia that extend along at least one face of the shank at predetermined offset angles relative to the sidewalls of the shank.

13. A multipurpose hand tool according to claim 12, wherein:

said predetermined offset angles correspond to common mark angles including 22.5 degrees and 45 degrees.

14. A multipurpose hand tool according to claim 12, wherein:

said set of visual indicia comprise grooves that are oriented at predetermined angles relative to the sides of the shank.

15. A multipurpose hand tool according to claim 1, wherein:

the shank includes a slot through the opposed faces of the shank that receives the elongate body of a nail for pulling the nail.

16. A multipurpose hand tool according to claim 15, wherein:

said slot is disposed 2⅝ inches from the top of the head.

17. A multipurpose hand tool according to claim 1, wherein:

the handle includes an elongate section and a larger end section that extends at an angle relative to the elongate section, wherein one side of the larger end section has a rib adapted to fit in the hip of the palm of the hand in use.

18. A multipurpose hand tool according to claim 17, wherein:

the angle between the elongate section and the larger end section is between 5 and 20 degrees.

19. A multipurpose hand tool according to claim 17, wherein:

the head includes co-planar base surfaces, and the larger end section has a surface that is oriented parallel to said base surfaces for line marking.

20. A multipurpose hand tool according to claim 19, wherein:

the surface is offset from said base surfaces at a distance of 16 inches.

21. A multipurpose hand tool comprising:

a head comprising a nail-pulling section that defines two tapered claw members extending rearward from a bridge section and a nail-striking section disposed forward of the bridge section;

a handle; and a shank extending from the bridge section of the head to the handle, the shank having a generally rectangular cross-section with opposed major faces and minor sidewalls extending therebetween, said opposed major faces defining a set of diamond shaped holes therethrough that include opposed corners pointing to said sidewalls;

wherein the nail pulling section and nail striking section include base surfaces that are substantially flat and aligned in a common plane, and the shank extends generally downward from the bridge section of the head in a direction substantially orthogonal to the common plane of said base surfaces; and wherein said holes are disposed at predetermined offsets along said shank relative to said base surfaces, said predetermined offsets corresponding to common mark lengths selected from the group consisting of 1.5 inches, 3.5 inches, and 5.5 inches.

22. A multipurpose hand tool according to claim 21, wherein:

the shank includes a set of visible indicia that are spaced apart at regular intervals along the shank to thereby define a ruler that can be used for measurement and marking.

23. A multipurpose hand tool according to claim 22, wherein:

said set of visual indicia comprises grooves disposed along edges of at least one face of the shank as well as numbers disposed along the at least one face of the shank.

24. A multipurpose hand tool according to claim 21, wherein:

the shank includes a set of visual indicia that extend along at least one face of the shank at predetermined offset angles relative to the sidewalls of the shank.

25. A multipurpose hand tool according to claim 24, wherein:

said predetermined offset angles correspond to common mark angles including 22.5 degrees and 45 degrees.

26. A multipurpose hand tool according to claim 25, wherein:

said set of visual indicia comprise grooves that are oriented at predetermined angles relative to the sides of the shank.

27. A multipurpose hand tool according to claim 21, wherein:

the shank includes opposing faces that are crowned (or concave).

28. A multipurpose hand tool according to claim 21, wherein:

the shank includes a slot through the opposed faces of the shank that receives the elongate body of a nail for pulling the nail.

29. A multipurpose hand tool according to claim 28, wherein:

said slot is disposed 2⅝ inches from the top of the head.

30. A multipurpose hand tool according to claim 21, wherein:

the shank has a width selected from 1⅜ inches and 1 7/16 inches.

31. A multipurpose hand tool comprising:

a head comprising a nail-pulling section that defines two tapered claw members extending rearward from a bridge section and a nail-striking section disposed forward of the bridge section, wherein the nail-pulling section defines two tapered claw members extending rearward with a cavity therebetween, the cavity accessible from the rear with an upper and lower slot leading thereto, the cavity for receiving a nail head therein with the upper and lower slots for receiving an elongate nail body therein;

a handle; and a shank extending from the bridge section of the head to the handle, the shank having a generally rectangular cross-section with opposed major faces and minor sidewalls extending therebetween, said opposed major faces defining a set of diamond shaped holes therethrough that include opposed corners pointing to said sidewalls;

wherein the nail pulling section and nail striking section include base surfaces that are substantially flat and aligned in a common plane, and the shank extends generally downward from the bridge section of the head in a direction substantially orthogonal to the common plane of said base surfaces; and wherein said holes are disposed at predetermined offsets along said shank relative to said base surfaces, said predetermined offsets corresponding to common mark lengths selected from the group consisting of 1.5 inches, 3.5 inches, and 5.5 inches.

* * * * *